United States Patent [19]

Hauck

[11] Patent Number: 4,481,684

[45] Date of Patent: Nov. 13, 1984

[54] SINGLE SLEEPER FURNITURE HAVING FLEXIBLE SUPPORT FRAME

[76] Inventor: Warren Hauck, 8020 Brooks Rd., Harrison, Ohio 45030

[21] Appl. No.: 366,843

[22] Filed: Apr. 9, 1982

[51] Int. Cl.[3] ..... A47C 17/06

[52] U.S. Cl. ..... 5/18 R; 5/186 R; 5/200 R

[58] Field of Search ..... 5/18 R, 13, 186 R, 200 R, 5/400, 17, 3, 6, 12 R, 51 E, 191, 247; 297/105, 109, 440

[56] References Cited

U.S. PATENT DOCUMENTS

| | | | |
|---|---|---|---|
| 146,518 | 1/1874 | Emery . | |
| 915,651 | 4/1909 | Appel . | |
| 1,120,349 | 12/1914 | Weinmann | 5/16 |
| 2,143,355 | 1/1939 | Martin . | |
| 2,200,052 | 5/1940 | Bowersox | 5/18 R |
| 2,392,688 | 1/1946 | Nagele | 5/18 R |
| 2,568,366 | 9/1951 | Rosen | 5/18 R |
| 2,642,584 | 6/1953 | Peterson | 5/18 R |
| 3,283,341 | 11/1966 | Cerchi | 5/17 |
| 3,972,079 | 8/1976 | Shellow et al. . | |
| 4,204,287 | 5/1980 | Lane . | |
| 4,292,697 | 10/1981 | Alembik . | |

FOREIGN PATENT DOCUMENTS

| | | | |
|---|---|---|---|
| 260695 | 4/1926 | United Kingdom | 5/3 |

*Primary Examiner*—Alexander Grosz
*Assistant Examiner*—Michael F. Trettel
*Attorney, Agent, or Firm*—Frost & Jacobs

[57] ABSTRACT

A frame assembly for use in a furniture structure such as an arm chair or coffee table using a plurality of linearly extensible flexible frames supporting a welded wire mesh. The frame elements are designed to resiliently flex to impart resiliency to the mesh support surface. The rearmost frame member is slidingly attached to the supporting furniture such that it may be pulled out in front of the furniture structure. The support frame is dimensioned to accommodate a single reclining person.

14 Claims, 6 Drawing Figures

SINGLE SLEEPER FURNITURE HAVING FLEXIBLE SUPPORT FRAME

SUMMARY OF THE INVENTION

Traditionally, residential homes have included a guest bedroom for temporary accommodations of family visitors. However, because of the high cost of housing, there appears to be a trend away from this concept. Consequently, there is substantial interest in alternate ways to accommodate overnight guests.

Probably the best known approach to solving this problem is the sofa bed which can be used as a conventional sofa in the daytime, but converts to a double bed when needed. This type of furniture usually uses a mechanically complicated folding arrangement where the sections of the bed unfold from within a storage space. The actual supporting surface of the bed is often formed by a plurality of coil springs which attempt to provide a comfortable sitting or reclining surface.

These features make sofa beds heavy, mechanically complicated and expensive. Furthermore, traditionally the sofa bed has been made as a full width sofa. Many times there is insufficient room space available to accommodate such a large piece of furniture.

The present invention provides a solution to these problems. It is directed to a linearly extensible flexible support frame which can be used with a variety of different types of furniture. The present invention is primarily directed to single sleeper furniture which converts into a bed which will accommodate one person. Consequently, the inventive principle can be applied to conventionally sized arm chairs, coffee tables, bars, wall cabinets and so forth.

For purposes of an exemplary showing, the flexible support frame of the present invention has been described and illustrated in connection with a chair structure of the type having a pair of spaced vertically extending arm members. The frame itself consists of a plurality of linearly extensible generally rectangular horizontal frame members which are slidingly joined to each other so that in a closed position the frame members lie in overlying relationship to form a seating surface and in an open position to form a reclining surface.

Each of these frame members includes a generally rectangular frame formed by L-shape angle braces located along the sides of the frame. Each of these angle braces includes a horizontal web portion and a vertical flange portion. The upper surface of the frame member forms a supporting mesh constructed of a plurality of metallic rods or wires extending between the side angle braces and a plurality of like rods or wires extending between the ends of the frame. The rods or wires are attached to each other at their points of intersection by welding or the like.

The frame and mesh are so constructed that the entire frame member is imparted with a degree of resiliency, so that a person sitting or reclining on the upper surface of the supporting mesh will cause the mesh to deflect downwardly. This imparts a more resilient sitting or reclining surface to each frame member and eliminates the need for coil springs or the like as in conventional designs. As will be explained in more detail hereinafter, it is believed this resiliency results from the specific design of the frame and mesh which permits the frame ends and sides to twist and/or deflect, and the mesh to recoverably bend.

Each frame member is supported from the floor by a vertical leg bearing a wheel or roller at its lower end. This arrangement permits the extensible sections to be easily moved inwardly or outwardly. Thus the sleeper arrangement can be easily handled by someone who might not otherwise be able to handle a heavy conventional sofa bed.

The frame of the present invention also includes means for slidably attaching the rearmost one of the frame members to the supporting furniture structure. In the case of a convention arm chair, this comprises a support secured to the inner surface of each of the chair arms which slidably supports the rearmost frame member, with the arms of the chair serving as the support for the back portion of the rear frame member. Consequently, when the frame members are in the closed position, they form a seating surface lying between the arm members. When the frame members are in the open position, they form a reclining surface where the rearmost frame member is pulled out from between the arm members. This insures that a person reclining on the bed is not forced to sleep between the arm members. This is particularly important in the case of a single sleeper bed design as in the present invention where the spacing between the arms may be much narrower than in the case of a conventional sofa.

Further features of the invention that relate specifically to the construction of the frame members which permit them to easily be assembled to each other and to the supporting furniture, as well as the folding mattress arrangement and storage facilities of the furniture accompanying the support frame, will become apparent from the detailed description which follows.

DETAILED DESCRIPTION

Figure 1:
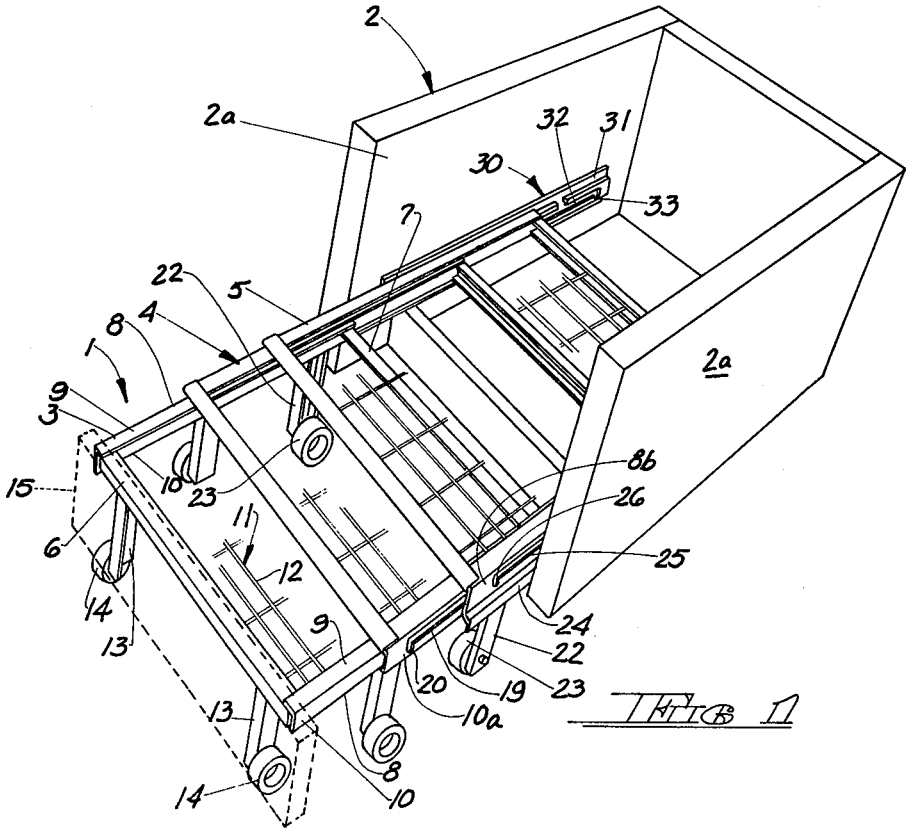
FIG. 1 is a front perspective view of the flexible support frame of the present invention attached to an arm chair with the frame in the partially opened position.
Figure 2:
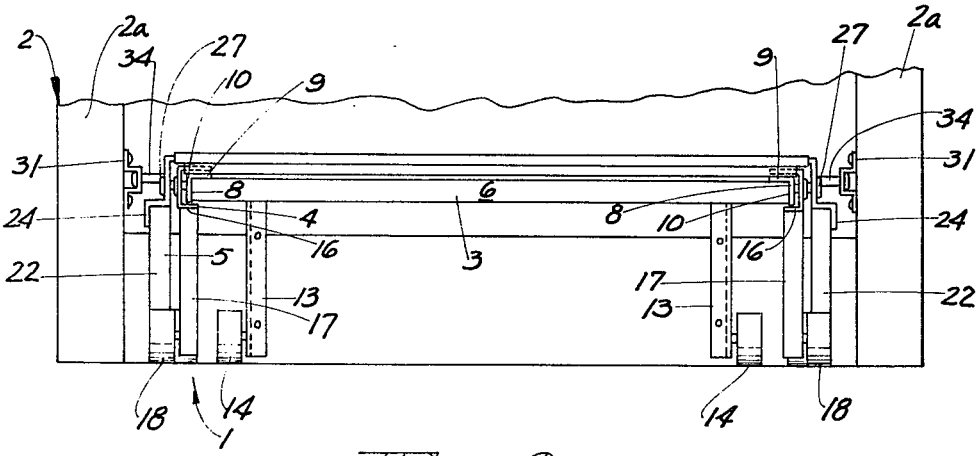
FIG. 2 is a fragmentary front elevation view of FIG. 1.
Figure 3:
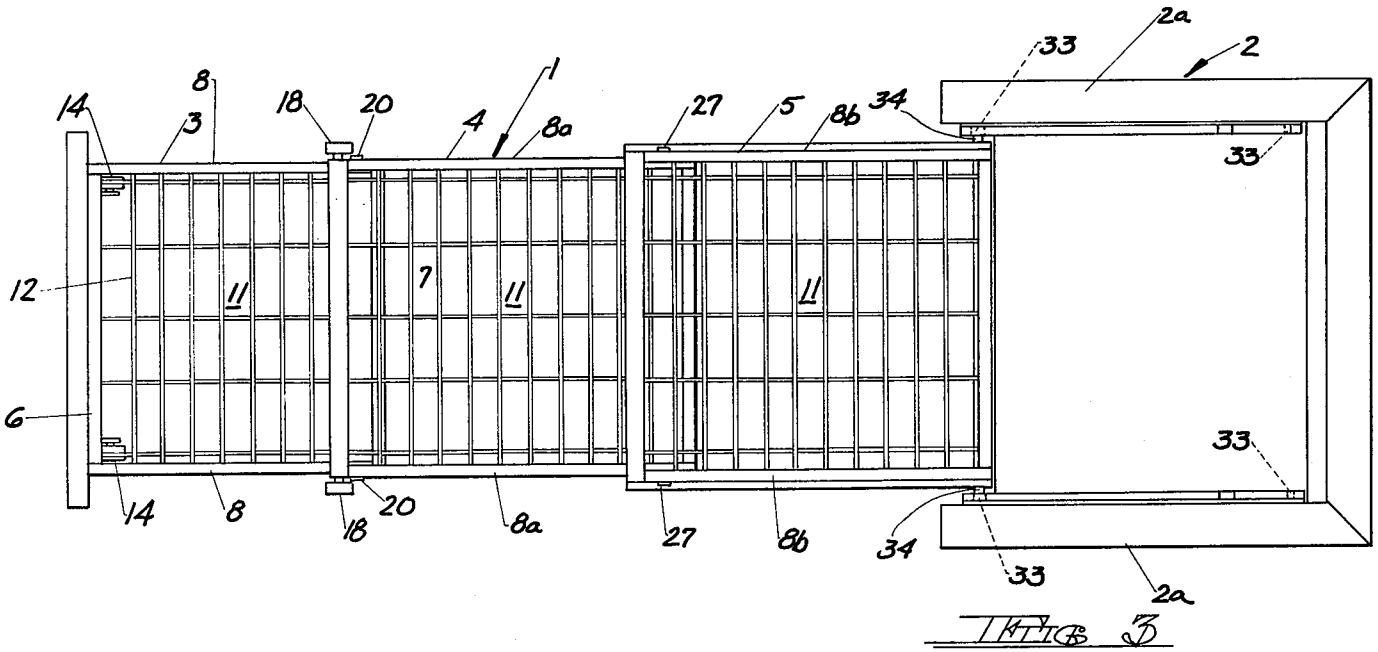
FIG. 3 is a top plan view of the flexible support frame of the present invention attached to an arm chair support with the frame members in the fully extended position.

The flexible support frame of the present invention is illustrated generally at 1 in FIG. 1. It will be understood that support frame 1 may be used with any type of supporting furniture such as an arm chair, sofa, coffee table, bar, wall cabinet or the like. However, for purposes of an exemplary showing, flexible support frame 1 has been described and illustrated herein in a first embodiment in connection with arm chair furniture, illustrated generally at 2 in FIG. 2.

It will be observed that frame 1 is composed of a plurality of linearly extensible generally rectangular horizontal frame members 3, 4 and 5, respectively. While the frame may be built with any number of frame members, the present embodiment has been described and illustrated with three frame members.

It will be observed that front frame member 3 is of slightly smaller width than middle frame member 4, which in turn is of slightly smaller width than rear frame member 5. This permits the frame members to telescope together, one inside the other. It will also be observed that when the frame members are pulled out to their fully opened points, their upper surfaces are generally coplanar.

Front frame member 3 is formed by a front L-shaped angle brace 6 and a rear elongated flat strip 7, which are interconnected at their outer edges by spaced parallel L-shaped side angle braces 8.

Each of the angle braces includes a horizontally extending elongated web portion 9 and a vertically extending elongated flange portion 10. (See FIG. 5). The materials, dimensions and thickness of the elements forming the frame are chosen so that they are not entirely rigid, but may bend or flex without breaking or becoming permanently deformed. In the present invention, for a frame member having a length and width of about 30 inches, it has been found that constructing the angle braces 6 and 8, and the elongated strip 7, from 14 gauge mild steel, satisfies these requirements.

The supporting surface of frame member 3 is formed by a welded wire mesh, shown generally at 11. Mesh 11 is made up of a plurality of longitudinally and transversely extending non-stretchable flexible wires, one of which is shown at 10. Wires 12 are fixedly attached at their ends by welding or the like to the undersurface of web portion 9 of the front and side angle braces, and to the underside of step 7. It will be observed that this arrangement forms a grid of wires 12 having elongated rectangular-shaped openings. The longitudinally and transversely extending wires 12 are then attached to each other at their points of intersection by welding or the like to form a welded wire mesh comprising the support surface of front frame member 3. In the specific frame construction described above, it has been found that 11 gauge low carbon mild steel wires used in a 2×4 grid pattern satisfies the bending and flexing requirement for frame 1. It will be understood that the resiliency of the mesh may be varied by proper choice of wire size and material and frame size and material.

Figures 4, 5, 6:
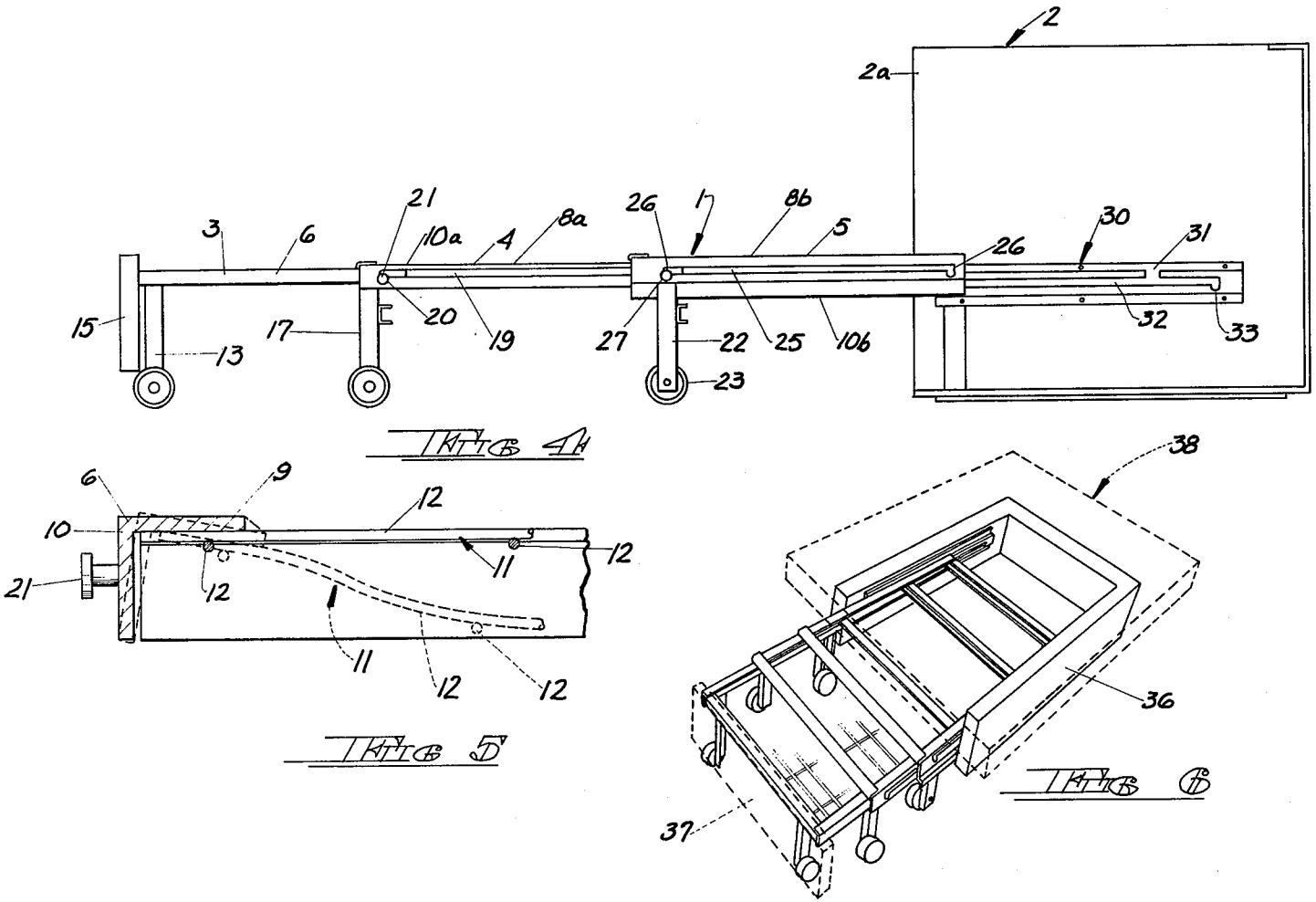
FIG. 4 is a side elevation view of the arrangement of FIG. 3 with the back and right arm members removed for clarity.
FIG. 5 is an enlarged fragmentary partially cross sectional view of a portion of a frame member of the present invention illustrating the deflection of the angle braces and support mesh.
FIG. 6 is a front perspective view of a second embodiment of the present invention utilizing the flexible support frame in conjunction with coffee table furniture, with the support frame illustrated in the partially extended position.

It has been found that the above described arrangement provides a resilient seating or reclining surface without the need for springs or the like as in conventional designs. The operation of this resilient surface is illustrated in greater detail in FIG. 5. In the unloaded state, mesh 11 forms a horizontal surface. When a downward force, such as a sitting or reclining person is applied to the upper surface of mesh 11, it deflects downwardly to the position shown in dashed lines in FIG. 5. Although wires 12 are substantially non-stretchable, it is believed this downward deflection is made possible by the twisting or deflection of the frame members to which the ends of the wires are secured. For example, as illustrated in FIG. 5, left-hand side angle brace 6 twists or deflects to the position shown in dashed lines. At the same time, there may be a certain amount of inward deflection or bowing of one or more of angle braces 6 or 8 or strip 7. Both of these motions permit the mesh to deflect to the position shown, thereby imparting a resilient nature to the supporting mesh. At the same time, wires 12 bend or deflect, thereby adding to the "give" or resiliency of the mesh. Consequently, this construction provides a resilient surface for sitting or reclining, and replaces conventional spring construction by supporting the mesh by a flexible frame. In other words, the resiliency of the individual springs used in conventional construction has been replaced by a resilient support frame where the sides and ends of the frame as well as the wire mesh itself, are intentionally designed to bend and deflect. It will be observed that similar construction is also used for middle frame member 4 and rear frame member 5, where elements similar to those previously described have been similarly designated.

A pair of spaced vertically extending legs 13 extend downwardly from the front edge of front angle brace 6 and bear at their lowermost ends rotatably mounted wheels or rollers 14, which permit front frame member 3 to be easily pulled outwardly or pushed inwardly. In addition, a kick plate 15 designated by dashed lines in FIG. 1, may be attached to the front end of front frame member 3 as is known in the art.

The construction of middle frame member 4 is similar to that previously described for front frame member 3. In this case, the spacing between the side angle braces is slightly greater so that the side angle braces of the front frame member may fit slidingly between them. Furthermore, the side angle braces of the middle frame member are provided with a horizontally and inwardly extending flange 16 which supports downwardly extending legs 17 at either side. The lower ends of leg 17 rotatably mount wheels or rollers which operate similarly to wheels 14. It will be observed that legs 17 are attached near the front edge of middle frame member 4 so that when the frame members are pushed together, legs 13 lie inwardly of legs 17.

As is best shown in FIG. 4, the flange portions **10*a* of the side angle braces of the middle frame member are supplied with an elongated longitudinally extending narrow slot 19. The frontmost end of slot 19 is provided with a lowered drop-slot 20 as can be seen in FIG. 1**.

A generally cylindrical headed pin 21 extends outwardly from the rear end of each side angle brace 8 of the front frame member 3 and slidingly cooperates within slot 19 so as to slidably join the front and middle frame members together. It will be observed that when front frame member 3 is fully extended from middle frame member 4, headed pin 21 drops into drop slot 20 to lock these frame members in place with respect to each other and prevent accidental closing.

The construction of rear frame member 5 is similar to that of middle frame member 4. Here the downwardly depending legs 22 with wheels 23 are attached at their upper ends to a skirt portion 24 which extends outwardly from the lower end of side angle braces **8*b*. Legs 22 are attached to the front ends of side angle braces 8*b*** so that when the middle and rear frame members are pushed together, the wheels and legs do not interfere with each other.

Each side angle brace **8*b* is provided with a narrow longitudinally extending slot 25 having a drop slot 26 at each end. A headed generally cylindrical pin 27 extends outwardly from the rear end of each side angle brace 8*a* of the frame member, and slidingly cooperates with slot 25 so as to slidingly join the middle and rear frame members. Consequently, when the middle frame member is fully extended from the rear frame member, pin 27** will be entrained within the front drop-slot 26 to lock these frame members together, while when the rear and middle frame members are pushed fully together, pin 27 will be entrained within the rear drop-slot 26 to lock these frame members in the closed position.

Flexible support frame 1 is attached to the associated furniture 2 by means illustrated generally at 30, which may be slightly modified depending upon the type of furniture with which the frame is used. In the embodiment illustrated in connection with arm chair furniture, attaching means 30 comprises an elongated channel-like plate 31 which is attached in a horizontal orientation to the inside surface of the vertically extending supporting arms or side members 2*a* of the furniture 2 by screws, nails or the like. Plate 31 includes a longitudinally extending narrow slot 32 having drop-slots 33 at either end. A headed generally cylindrical pin 34 extends outwardly from the rear end of side angle braces 8*b* of the rear frame member, and slidingly cooperates within slot 32 in order to slidingly attach the rear frame member and thus the flexible support frame 1 to the supporting furniture structure.

It will be observed that the front end of plate 31 is located near the front edge of the associated supporting arm 2*a*. Consequently, when the frame 1 is pulled out to the fully opened position, the rearmost edge of the rear frame member 5, which represents the rearmost edge of the reclining surface, lies close to the front edge of the supporting arms. As a result, a person is not forced to recline between the arms of the supporting furniture structure, while being assured of body support along the entire length of the flexible support frame 1. This is particularly advantageous where the support frame is used in conjunction with a narrow furniture structure such as a conventionally sized arm chair. Thus the design is particularly suitable for single sleeper designs, i.e. single width beds.

To facilitate assembling the flexible support frame 1 to the furniture 2, an opening 35 is provided in the upper edge of slot 32 through which pin 34 may be inserted in order to guide the pin into slot 32. In this way, the flexible support frame and the furniture (which itself may be of knock-down construction) may be shipped or stacked as separate units. This also facilitates the use of a single design for the flexible support frame for use with a number of different types of furniture such as the arm chair illustrated in FIG. 1, or other types such as a coffee table, bar, wall cabinet, etc.

For example, FIG. 6 illustrates the flexible support frame of the present invention used in connection with a coffee table. In this design, the channel-like plates 31 are attached to spaced supporting side members 36 of the coffee table, while kick plate 15 has been replaced by a suitable side 37 of the coffee table 38.

It will be understood that various changes in the details, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In furniture structure of the type having a pair of spaced vertically extending side members, the improvement in combination therewith comprising:

a plurality of linearly extensible generally rectangular frame member means slidingly joined to each other so that in a closed position the frame members may lie in overlying relationship within the furniture structure and in an opened position the frame members are substantially coplanar to form a generally horizontal reclining surface outside of the furniture structure, each of said frame member means comprising a generally rectangular frame and a plurality of substantially non-stretchable wires attached to their ends to spaced locations on the frame to form a supporting mesh;

leg means for supporting each of said frame members from the floor; and means for slidably attaching said frame between the side members of the furniture structure such that when said frame is pulled out to the opened position, the rearmost one of said frame members will be positioned such that the reclining surface does not extend between the side members, said rearmost frame member being slidably attached to the inside surfaces of said side members, said attaching means including an elongated horizontally extending slot provided on the inside surface of each of said side members and a pin extending outwardly from each side of the rearmost frame member slidingly cooperating with said slot.

2. The apparatus according to claim 1 including a vertical slot intersecting said elongated slot into which said pin can be inserted to attach the frame to the furniture structure.

3. The apparatus according to claim 1 wherein said furniture structure comprises an arm chair, said side members forming the arms of the chair.

4. The apparatus according to claim 1 wherein said furniture structure comprises a coffee table having a table-like upper surface and side walls supporting said upper surface and forming said side members.

5. The apparatus according to claim 1 wherein the width of said frame is dimensioned to accommodate a single reclining person.

6. The apparatus according to claim 1 wherein said frame is configured such that a person sitting or reclining on the support mesh causes deflection of a portion at least of said frame to produce a resilient sitting or reclining surface.

7. The apparatus according to claim 6 wherein said frame comprises a pair of spaced parallel side frame elements and a pair of spaced parallel end frame elements, some of said wires extending between opposed points on said side frame elements, other ones of said wires extending between opposed points on said end frame elements such that said wires form points of intersection.

8. The apparatus according to claim 7 wherein said wires are attached to each other at their points of intersection.

9. The apparatus according to claim 8 wherein said side frame elements are configured to enable them to resiliently twist when said supporting mesh is deflected downwardly.

10. The apparatus according to claim 9 wherein said side frame members are of L-shaped cross section comprising a horizontal web portion and a vertical flange portion, the ends of said wires being attached to said web portions.

11. The apparatus according to claim 1 wherein said attaching means comprises means for slidably attaching the rearmost one of said frames to the furniture structure.

12. The apparatus according to claim 11 including said furniture structure comprising an arm chair having a pair of spaced vertically extending arms, said slidably attaching means being secured to the inner surfaces of said arms such that said rearmost frame may be pulled out from between the arms, one of said frames forming a seating surface when the frames are in the closed position.

13. The apparatus according to claim 11 including said furniture structure comprising a coffee table having an upper horizontal table-like surface and a pair of spaced sides supporting the table-like surface from the floor, said attaching means being secured to the inner surface of the sides such that said frames lie within the coffee table when the frames are in the closed position and such that said rearmost frame may be pulled out from within the coffee table.

14. The apparatus according to claim 11 wherein the width of said frames are dimensioned to accommodate a single reclining person.

* * * * *